US005488371A

United States Patent [19]

Targove

[11] Patent Number: 5,488,371

[45] Date of Patent: Jan. 30, 1996

[54] RADIO FREQUENCY ABSORBING WINDOWS

[75] Inventor: James D. Targove, Sudbury, Mass.

[73] Assignee: Litton Systems, Inc., Lexington, Mass.

[21] Appl. No.: 236,500

[22] Filed: Apr. 29, 1994

[51] Int. Cl.[6] ..... H01Q 17/00

[52] U.S. Cl. ..... 342/1

[58] Field of Search ..... 342/1, 2, 4

[56] References Cited

U.S. PATENT DOCUMENTS

| | | | |
|---|---|---|---|
| 3,431,348 | 3/1963 | Nellis et al. | 342/1 |
| 3,453,620 | 7/1969 | Fleming et al. | 342/1 |
| 4,038,660 | 7/1977 | Connolly et al. | 343/18 A |
| 4,162,496 | 7/1979 | Downen et al. | 342/1 |
| 4,924,228 | 5/1990 | Novak et al. | 342/2 |
| 5,003,311 | 3/1991 | Roth et al. | 342/2 X |
| 5,169,713 | 12/1992 | Kumurdjian | 342/1 X |

OTHER PUBLICATIONS

Knott, E. F., et al., "Radar Cross Section," Second Edition, consisting of pp. 9, 320–325, and 327.

Pazol, B. G., et al., "Development of sapphire windows for use in high-quality IR imaging systems," SPIE vol. 1760 *Window and Dome Technologies and Materials III*, pp. 55–65, (1992).

*Primary Examiner*—Mark Hellner

*Attorney, Agent, or Firm*—Michael H. Wallach

[57] ABSTRACT

A light transparent window is fabricated to absorb a band of radio frequency (RF) energy with minimal RF transmission and reflection. The window is formed from a series of parallel electrically conductive sheets separated by absorbing cavities. The conductive sheets are formed by depositing a layer of doped semiconductor material onto a thin layer of sapphire. The absorbing cavities are formed by an air-filled space between the conductive sheets. Radio frequency reflection can be further attenuated by an antireflection coating, which is preferably realized by a non-conducting sapphire sheet separated from the series of conductive sheets by an air-filled space. Depending on the number of cavities, reflection and transmission attenuation of over 25 dB can be obtained for radio frequency energy in the 2 to 18 GHz band.

52 Claims, 7 Drawing Sheets

RADIO FREQUENCY ABSORBING WINDOWS

BACKGROUND OF THE INVENTION

The absorption of Radio Frequency (RF) radiation is a desirable solution to many Electromagnetic Interference (EMI) applications, with the alternative being the reflectance of the radiation. RF absorbing materials are well known, but most of these materials are optically opaque. RF absorbing materials do not exist that are suitable for use as a high quality optical window.

Jaumann absorbers are an established class of broadband RF absorbers composed of thin electrically conductive layers separated by spacers having a low dielectric constant. The conductivity of the thin layers increases (sometimes exponentially) with position away from the surface. The RF radiation is therefore allowed to penetrate into the absorber before being absorbed. Jaumann absorbers are sensitive to the angle of incidence, but the absorption bandwidth of a Jaumann absorber can be increased by the addition of additional conductive sheets with spacers. However, Jaumann absorbers are fabricated from optically opaque materials.

There are Electromagnetic Interference (EMI) applications in which an optical window with RF absorbing properties is desirable. One example is an optical viewing port in a radar test chamber where the internal walls must be absorbing.

SUMMARY OF THE INVENTION

A preferred embodiment of the invention is a radio frequency (RF) absorbing window that has minimal RF transmission and reflection. A preferred embodiment of the invention is a visually or infrared transparent window that efficiently absorbs RF (millimeter wave, microwave or low frequency) radiation. A preferred embodiment employs a series of absorbing cavities bounded by respective electrically conductive sheets. Each conductive sheet can be an electrically conductive thin film or mesh deposited onto a thin base layer of non-conductive optically transparent material, such as, sapphire or silicon. Other base materials include GaAs, ZnS, ZnSe, Ge, GeS or other compound semiconductors. The conductive sheets are separated by non-electrically conductive low-index light transmissive spacers, such as air spacers, to form the absorbing cavities.

A preferred embodiment of the invention is a light transparent, RF absorbing panel disposed between an external environment and an internal environment, such as a cockpit, a sensor cavity or electronics chamber. The external environment includes electromagnetic radiation such as light and undesired RF signals. The panel is a layered structure of parallel light transparent conductive sheets and light transparent dielectric material disposed between adjacent conductive sheets. The conductivity of the conductive sheets increases from the front sheet near the external environment to the back sheet near the internal environment. Thus, the panel is essentially a light transparent Jaumann absorber.

Each conductive sheet is spaced from an adjacent conductive sheet by an intermediate distance, which is determined as a function of a predetermined radio frequency so the conductive sheets absorb substantially all energy at the predetermined radio frequency. The predetermined radio frequency can be selected to be a center frequency of a predetermined frequency band, such as the X band. The dielectric material between the conductive sheets creates Fabry-Perot interference cavities for absorbing the RF radiation.

In a particular preferred embodiment, each conductive sheet is fabricated from a rigid layer of thin, light transparent material that provides a structural base to the conductive sheet. In particular, the rigid layer can comprise silicon or sapphire. A thin layer of light transparent electrically conducting material is formed on the front side of the rigid layer to provide an electrical conductor. The conducting material can be a doped semiconductor material such as doped silicon, or a metal oxide such as indium tin oxide (ITO).

Radio frequency absorption is facilitated by an antireflection (AR) coating disposed on the light incident (i.e., front) side of the panel. The AR coating is preferably an outer dielectric layer formed of an interface sheet spaced from the front conductive sheet by a light transparent non-electrically conductive dielectric material disposed between the interface sheet and the front conductive sheet to create an antireflection interference cavity.

In particular preferred embodiments, the light transparent dielectric material has an index of refraction of about one at the predetermined frequency. At radio frequencies, such dielectric material includes air and inert gasses. The dielectric material can also be an aerogel. Furthermore, the spacing distance between conductive sheets is approximately one-quarter of a wavelength at the predetermined radio frequency.

BRIEF DESCRIPTION OF THE DRAWINGS

The above and other features of the invention, including various novel details of construction and combinations of parts, will now be more particularly described with reference to the accompanying drawings and pointed out in the claims. It will be understood that the particular radio frequency absorbing windows embodying the invention are shown by way of illustration only and not as a limitation of the invention. The principles and features of this invention may be employed and varied in numerous embodiments without departing from the scope of the invention.

DETAILED DESCRIPTION OF PREFERRED EMBODIMENTS OF THE INVENTION

Preferred embodiments of the invention are optically transparent RF absorbing windows having minimal RF transmission (T) and reflection (R). In preferred embodiments of the invention, RF transmission and reflectance is attenuated by at least 20 dB (i.e., T and R <1%). In particular, RF transmission and reflection is attenuated by about 30 dB (i.e., T and R <0.01%). This microwave performance preferably covers the 2–18 GHz frequency range to protect against the range of radar bands that are typically specified as threats to aircraft. One such radar band is the X band (i.e., 8–12 GHz), which is used for airborne intercept and missile guidance radars. The embodiments described herein can be adapted to absorb any band of millimeter-wave or RF energy and to transmit either infrared or visible light. For example, an RF absorbing window can be incorporated into the wall of an indoor radar range to absorb outbound microwave radiation and allow direct viewing of the test setup. An RF absorbing window can also be used to provide an optical entry window into a sensor cavity having sensitive electronic components shielded from broadband electromagnetic interference (EMI).

Figure 1A:
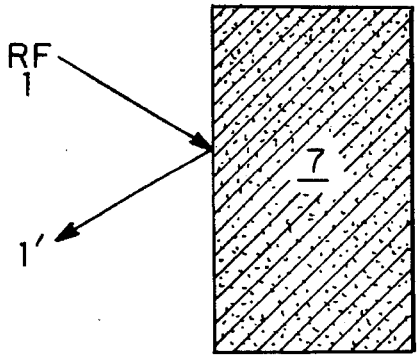
FIG. 1A (Prior Art)
FIGS. 1A–1B are schematic diagrams illustrating a cross-sectional view of prior art reflective RF rejecting windows.
Figure 1B:
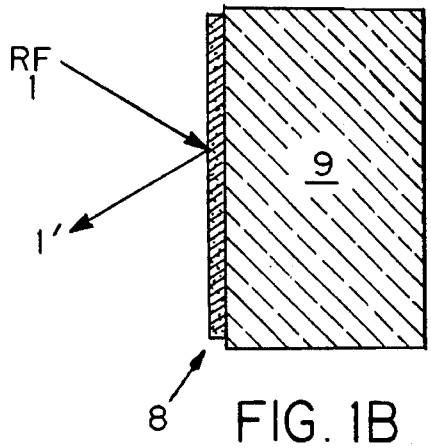
FIG. 1B (Prior Art)

FIGS. 1A–1B are schematic diagrams illustrating cross-sectional views of conventional reflective RF rejecting windows. FIG. 1A illustrates a window fabricated from a doped semiconductor 7, such as germanium, silicon or gallium arsenide. The doped semiconductor 7 reflects the majority of incident RF energy 1 and absorbs the remaining RF energy. FIG. 1B illustrates an undoped substrate 9, such as sapphire, zinc sulfide, or zinc selenide coated with a doped semiconductor coating 8, a conductive mesh or a layer of ITO. The coating 8 or mesh functions as a lossy mirror to reflect the majority of the incident RF energy 1 and to absorb the remaining energy from the incident RF wave 1.

Although the reflection of incident RF energy 1 is acceptable in some applications, there are other applications where the reflection of RF energy 1' must be significantly attenuated. Although RF absorbing materials are known in the prior art, there are no effective light transparent RF absorbers. In preferred embodiments of the invention, light transparent RF absorbing windows are fabricated to dramatically inhibit RF transmission and reflection.

Preferred embodiments of the invention employ a thin-film interference approach, with the material properties chosen appropriately for the microwave range. TABLE 1 below lists approximate microwave refractive indices for useful infrared transparent materials. Most of these materials have refractive indices of 2.5 or higher; the lack of low-index materials makes a light transparent RF absorbing window difficult to design and fabricate. Air is a very useful microwave low-index material, because an air gap spacing can be held to a fraction of a wavelength, which is 3 cm at 10 GHz. Plastics maintain a low refractive index of 1.5 to 1.6 in the microwave region, but it is difficult to make high optical quality plastic components in millimeter thickness. The use of plastic components, however, is within the scope of the invention.

TABLE 1

| MATERIAL | REFRACTIVE INDEX |
|---|---|
| Fused Silica | 2.0 |
| BK7 | 2.1 |
| Sapphire | 3.0, 3.3 (Birefringent) |
| Silicon | 3.5 |
| Germanium | 4.0 |
| Gallium Arsenide | 3.5 |
| Zinc Sulfide | 2.9 |
| Zinc Selenide | 2.8 |
| Diamond | 2.3 |
| Calcium Fluoride | 2.5 |
| Plastics | 1.5 to 1.6 |

Figure 2:
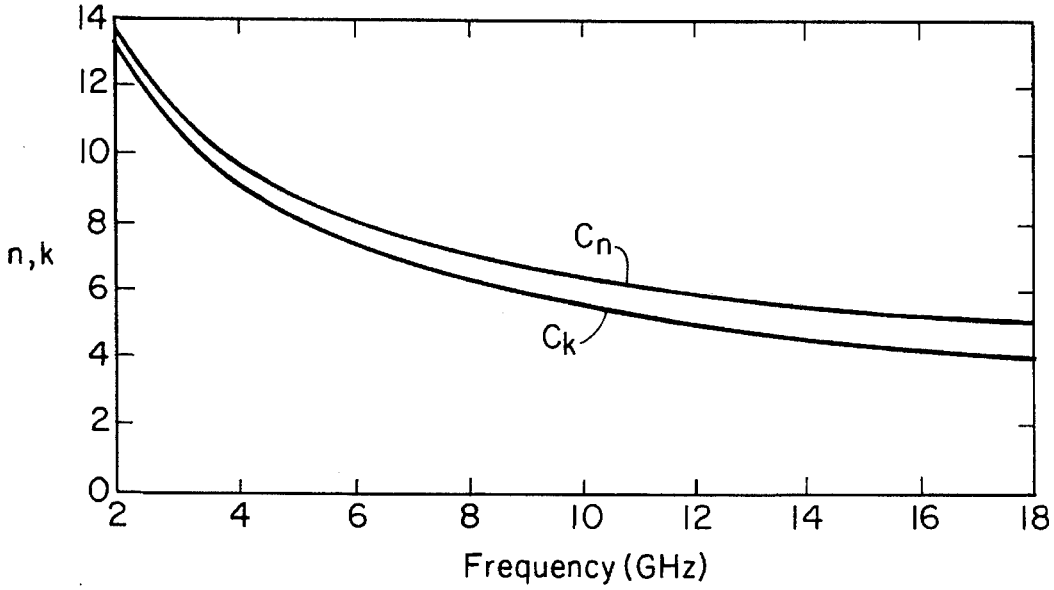
FIG. 2 is a graphical diagram illustrating optical constants for 2.5 Ω-cm silicon.

Doped semiconductors are also available in either bulk or thin film form. The optical constants in preferred embodiments of the invention have been calculated using the Drude theory approximation (see M. Kohin et al., "Analysis and Design of Transparent Conductive Coatings and Filters," Optical Engineering 32 (5):911–25 (1993)). This model is a function of the resistivity, mobility, and undoped material dielectric constant, and is accurate in the microwave region. FIG. 2 is a graphical diagram illustrating, as an example, the optical constants for 2.5 Ω-cm silicon. As the resistivity decreases, the index of refraction (n) and the extinction coefficient (k) become more approximately equal and independent of the mobility.

Figure 3:
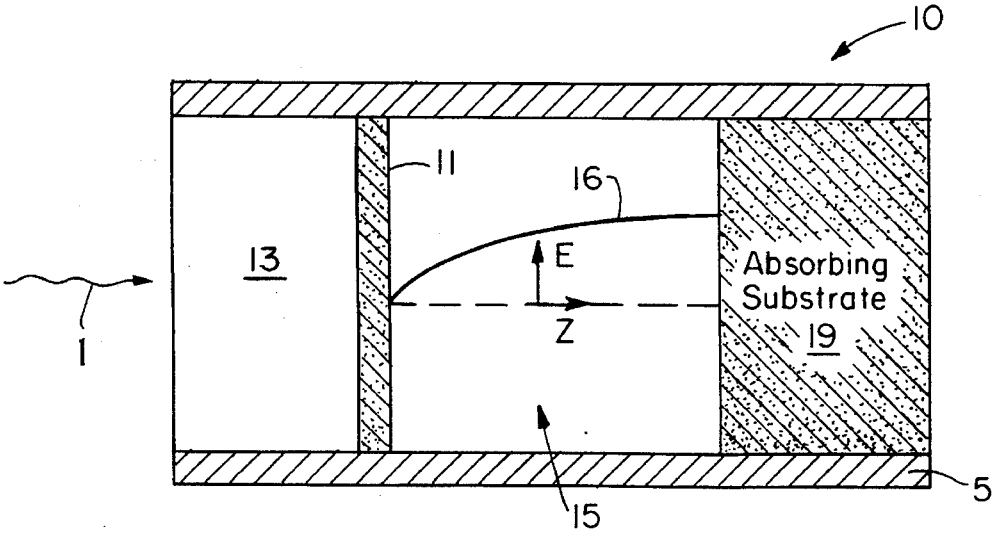
FIG. 3 is a schematic diagram illustrating a cross-sectional view of a single-cavity dark mirror device according to a preferred embodiment of the invention.

FIG. 3 is a schematic diagram illustrating a cross-sectional view of a single-cavity dark mirror 10 having doped semiconductors 11,19 serving as absorbing mirrors. In a preferred embodiment of the invention, a sheet of doped semiconductor material 11 forming a lossy mirror is spaced apart from a doped semiconductor substrate 19 by a cavity 15. The spacing between the semiconductor sheet 11 and the substrate 19 is maintained by a housing 5, which frames the dark mirror 10. For clarity of the following description and to facilitate understanding of the invention, the housing 5 will not be further shown or described. It should be understood that RF absorbing windows are mounted within a suitable housing as is well-known in the prior art.

The dark mirror 10 is essentially a Fabry-Perot filter with absorption in the doped semiconductors 11,19 and/or the cavity 15. The cavity 15 facilitates the formation of an electric field standing wave 16 in the cavity 15 as shown. The Fabry-Perot cavity interference effects reduce reflection, with the cavity mirror 11 absorbing part of the radiation and the substrate 19 absorbing the remaining radiation to minimize the transmission.

For an infrared transmitting dark mirror 10, the absorption must occur in the mirror 11 because there are no available materials that absorb in the microwave region but transmit in the infrared. In a preferred embodiment, doped semiconductor films are used as the absorbing mirror 11. For properly chosen doping levels, the films are infrared transparent and slightly absorbing in the microwave region. In a particular preferred embodiment of the invention, the dark mirror 10 uses a silicon mirror 11 and an air spacer layer optimized for 10 GHz. The reflection can be further attenuated by adding a low-index antireflection coating 13 to the outside of the mirror 11 as shown. The antireflection coating 13 can be a thick (few millimeters) polymer layer having an RF index of 1.5. The antireflection coating 13 can also be an air-layer antireflection coating as will be further described below.

Figure 4B:
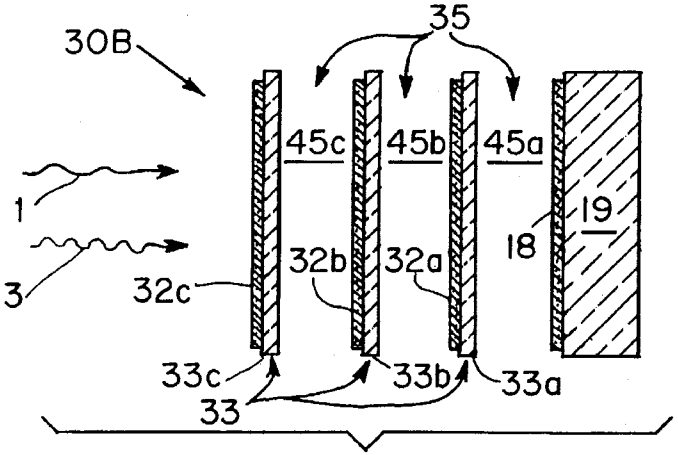
FIGS. 4A–4B are schematic diagrams illustrating a cross-sectional view of a three-cavity RF absorbing window according to a preferred embodiment of the invention.
Figure 4A:
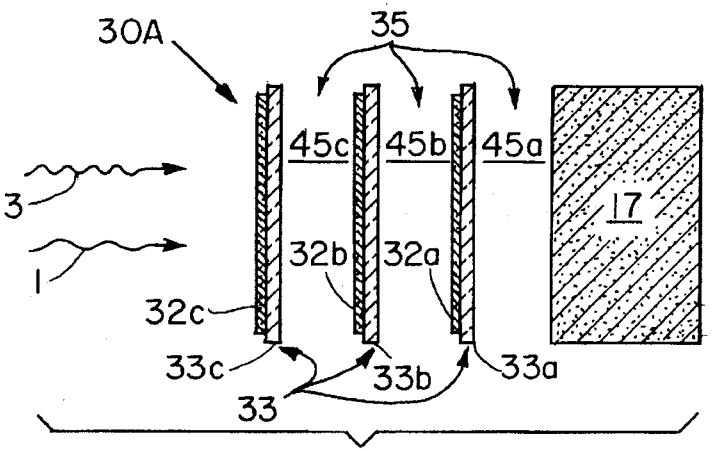

FIGS. 4A–4B are schematic diagrams illustrating cross-sectional views of preferred embodiments of a three-cavity RF absorbing window 30A,30B based on thin sapphire technology. FIG. 4A employs a semiconducting rear substrate 17, such as doped germanium, silicon or gallium arsenide. FIG. 4B illustrates the use of an insulating rear substrate 19, such as doped semiconductor-coated sapphire. In the figures, radio frequency radiation 1 and light 3 are incident from the left. The conductive sheets 33 are coated on one side by a doped semiconductor 32. As illustrated, the doped semiconductor 32 is coated on the front (i.e., light incident) side of the conductive sheets 33. It will be understood that the doped semiconductor 32 can also be coated on the back side of the conductive sheets. Behind each conductive sheet **33*a*–33*c* is an intermediate air gap 35*a*–35*c* to form an interference cavity. If the back side substrate 17,19 is one or two millimeter thick sapphire, the window 30A, 30B** can be exceedingly light. A dielectric constant of 9 was assumed for the sapphire in the RF.

The semiconductor films have a sheet resistance of hundreds of Ω/□. To achieve these values with coatings less than 10 microns thick requires resistivities of less than 1 Ω-cm. Coatings of 1.0, 0.1, and 0.01 Ω-cm semiconductors can be used and are readily available in practice. The coating thickness is on the order of a micron, which is a reasonable thickness from a production standpoint.

In a preferred embodiment of the invention, the window must maintain a high infrared transmittance while modifying the RF response. Because doped semiconductors typically exhibit free carrier absorption in the infrared, care must be taken to avoid infrared absorption. For the film resistivities and thicknesses used in preferred embodiments of the invention, infrared absorption is negligible for all layers except the rear conducting substrate 17 or coated insulating substrate 19, which must attenuate the RF transmission. The substrate 17,19 is selected to provide the required transmission attenuation with acceptable infrared absorption. This trade is easier for the absorbing window than for a conventional RF reflecting window because of the electric field reduction in the absorbing window structure. This lower electric field at the substrate 17,19 allows a less conductive substrate to provide the necessary attenuation.

Figure 5B:
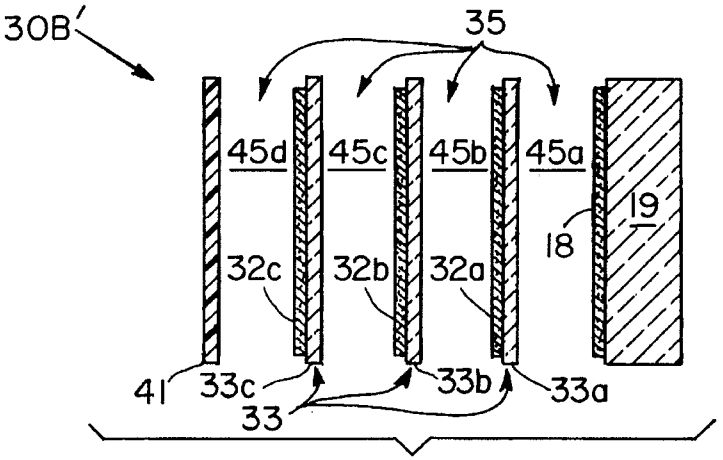
FIGS. 5A–5B are schematic diagrams illustrating a cross-sectional view of a three-cavity RF absorbing window having an antireflection cavity according to a preferred embodiment of the invention.
Figure 5A:
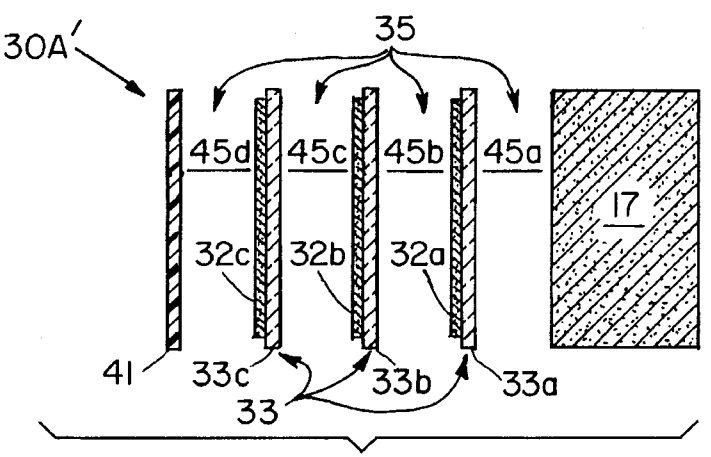

FIGS. 5A–5B are schematic diagrams illustrating cross-sectional views of preferred embodiments of a three-cavity window 30A', 30B' having an antireflection coating. A sapphire interface sheet 31 is separated from the series of doped semiconductor coated sapphire sheets **33*a*–33*c* by a respective air gap 35*d* to form the antireflection coating. The antireflection coating for the embodiments of FIGS. 5A and 5B is the layer of air 35*d* separated from the external environment in the front by the thin sapphire pane 31. The three-cavity RF absorbing windows 30A', 30B' of FIGS. 5A–5B are otherwise identical to corresponding windows 30A,30B of FIGS. 4A–4B**.

Figure 6:
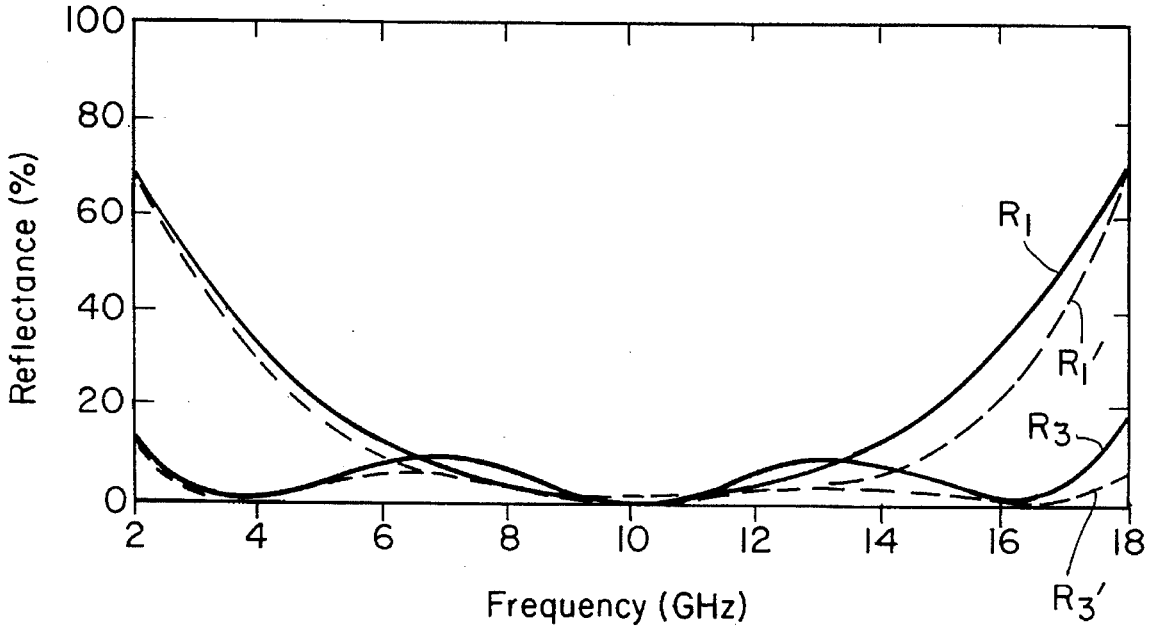
FIG. 6 is a graphical diagram of the reflectance of single-cavity and triple-cavity dark mirrors relative to frequency.

FIG. 6 is a graphical diagram comparing the reflectance of the single-cavity dark mirror 10 of FIG. 3 with the triple-cavity dark mirrors 30A,30A' of FIGS. 4A and 5A. Curve $R_1$ illustrates the performance of the dark mirror 10 without an antireflection coating 13. Curve $R_1'$ illustrates the performance of the dark mirror 10 with an antireflection coating 13. Although the antireflection coating 13 further attenuates the reflectance from the dark mirror 10, the behavior remains narrow in frequency. Curve $R_3$ illustrates the reflectance of the triple-cavity dark mirror 30A without an antireflection coating. Curve $R_3'$ illustrates the reflectance of the triple-cavity dark mirror 30A' with the antireflection coating. As can be seen from FIG. 6, the absorption band is widened as a result of going from a single-cavity 10 to a triple-cavity 30A dark mirror.

Figure 7:
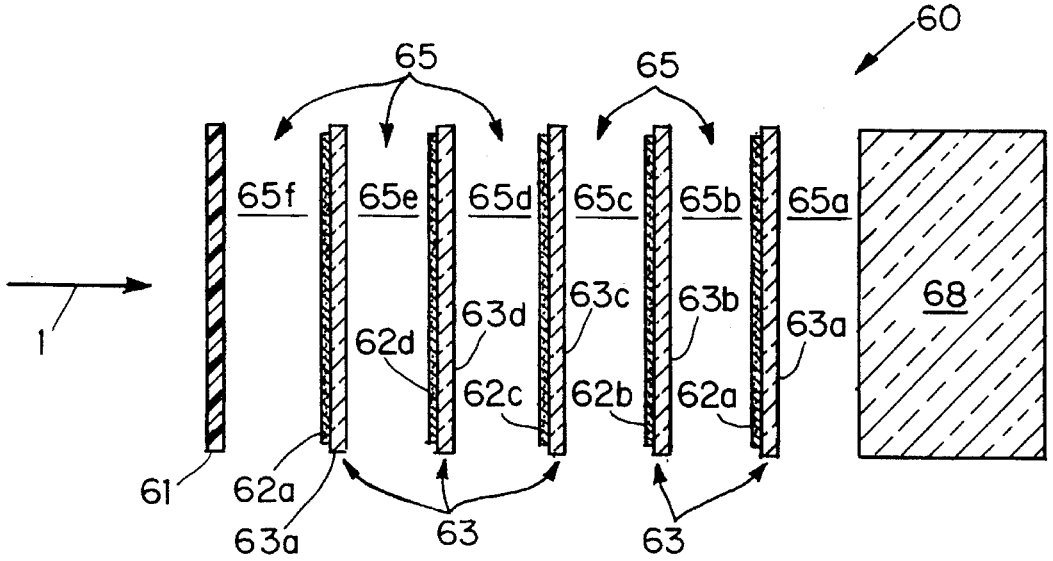
FIG. 7 is a schematic diagram illustrating a cross-sectional view of a five-cavity RF absorbing window according to a preferred embodiment of the invention.

FIG. 7 illustrates a cross-sectional view of a preferred embodiment of a five-cavity RF absorbing window. An undoped silicon substrate is employed as the back element 68. TABLE 2 specifies in details the material requirements for the five-cavity absorbing window of FIG. 7. The index of refraction for the sapphire is 3.0. The 0.1 and 0.01 Ω-cm semiconductor can be any semiconductor material. The 1.0 Ω-cm material thickness is weakly dependent on the coating material. In a preferred embodiment of the invention, the effective mass (m*) equals 0.35, the mobility (μ) equals approximately 27 $cm^2$/V-sec and the permittivity ($\epsilon_h$) equals approximately 5. The specifications can be modified to alter the attenuation at the frequency extremes. Preferably, the specifications are optimized by any commercially-available thin-film design package that functions for the microwave region.

TABLE 2

| Layer Reference No. | Material | Resistivity (Ω-cm) | Physical Thickness (μm) |
|---|---|---|---|
| 58 | Silicon | 5–10 | 1000 |
| 55a | Air | | 7473.0 |
| 53a | Sapphire | | 125 |
| 52a' | Semiconductor | 0.1 | 1.905 |
| 52a" | Semiconductor | 0.01 | .1625 |
| 55b | Air | | 6999.7 |
| 53b | Sapphire | | 125 |
| 52b' | Semiconductor | 0.1 | 1.049 |
| 52b" | Semiconductor | 0.01 | 0.0756 |
| 55c | Air | | 6543.8 |
| 53c | Sapphire | | 125 |
| 52c' | Semiconductor | 1 | 4.131 |
| 52c" | Semiconductor | 0.1 | 0.667 |
| 55d | Air | | 6420.0 |
| 53d | Sapphire | | 125 |
| 52d' | Semiconductor | 1 | 2.626 |
| 52d" | Semiconductor | 0.1 | 0.466 |
| 55e | Air | | 6258.0 |
| 53e | Sapphire | | 125 |
| 52e' | Semiconductor | 1 | 2.046 |
| 52e" | Semiconductor | 0.1 | 0.251 |
| 55f | Air | | 6837.0 |
| 53f | Sapphire | | 125 |
| 52f' | Semiconductor | 1 | 2.249 |
| 52f" | Semiconductor | 0.1 | 0.323 |
| 55g | Air | | 4323.8 |
| 51 | Sapphire | | 125 |

To achieve acceptable performance, the rear coating requires a lower sheet resistance than the others. In a preferred embodiment, two coating runs per conductive sheet are used to fabricate the window and the rear (i.e., light egressing side) layer is thicker than the other layer. The use of multiple coating runs facilitates the use of commercially available semiconductors. In a preferred embodiment, the sapphire thickness is 5 mils.

Figure 8:
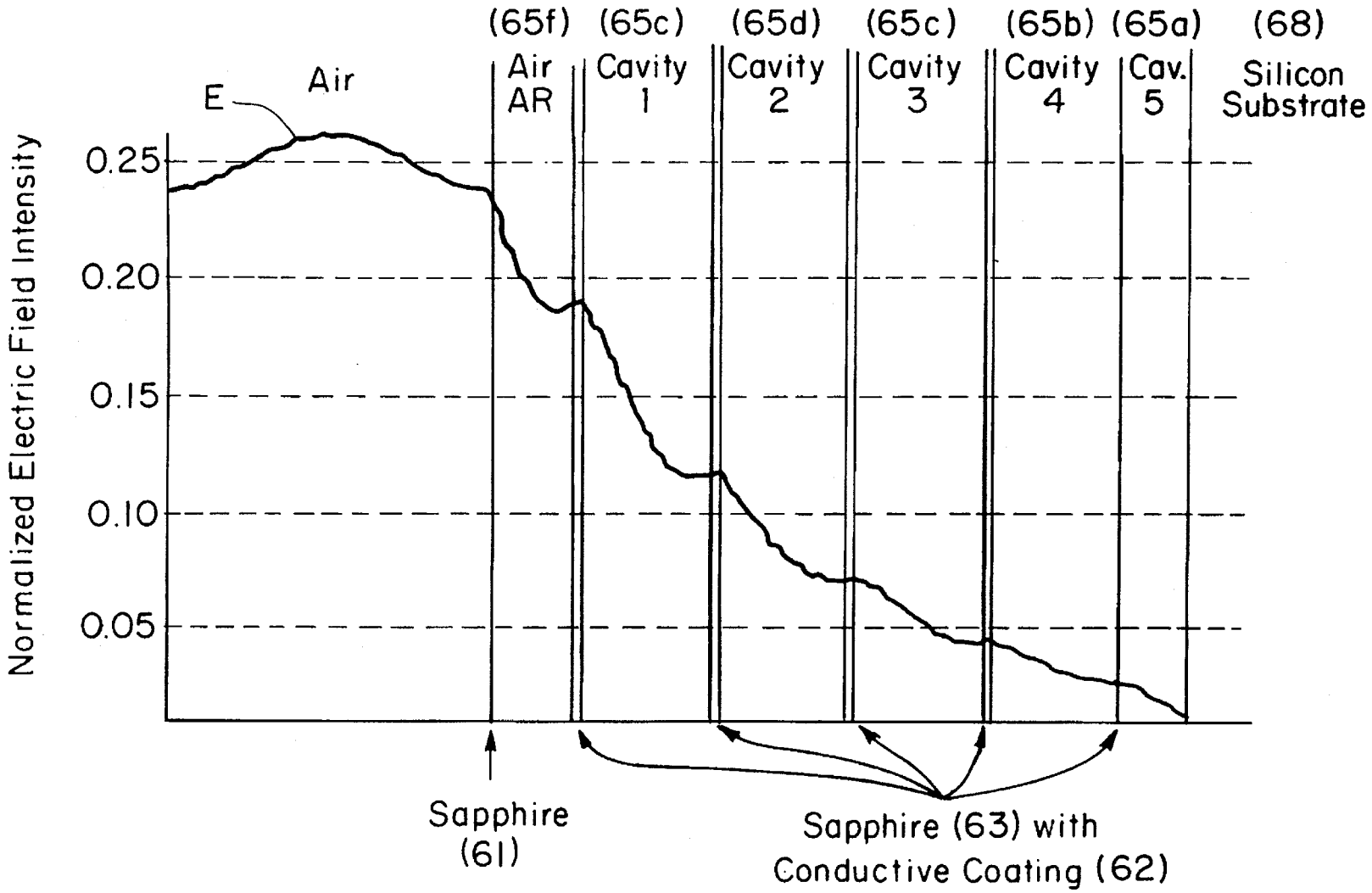
FIG. 8 is a graphical diagram illustrating the electric field distribution for a five-cavity dark mirror of the invention.

FIG. 8 is a graphical diagram illustrating the electric field distribution at the design wavelength for a five-cavity dark mirror 50. In the figure, light is incident from the left. The electric field distribution shows that preferred embodiments of an RF absorbing window work by additional attenuation of the incoming wave in each successive cavity. The electric field strength at the rear substrate is therefore several orders of magnitude below the incident field strength. In particular, FIG. 8 illustrates the electric field distribution of a dark mirror having a silicon substrate and five sheets of sapphire coated with a conductive layer. Furthermore, the dark mirror includes an incident wave facing sheet of sapphire that forms an antireflection coating of air between the interface sheet and the first conductive coated sapphire sheet. Thus, the dark mirror can be viewed as having six cavities, five absorbing cavities and one antireflection cavity.

A fundamental problem is that the semiconductor layers between the cavities have to be less than one mil thick for optimum performance. Freestanding semiconductor wafers that thin are impractical. Filling the cavities with material so the semiconductors could be deposited as films onto a slab of material is one alternative. It is difficult however, to design a broadband absorber with a spacer refractive index much larger than one. The spacers, therefore, were chosen to be air, or an inert gas.

Thin sapphire is a solution to the material limitations. Large sapphire sheets as thin as 5 mils have been fabricated with acceptable transmitted wavefront quality. A preferred technique for fabricating thin optical grade sapphire ($Al_2O_3$) sheets was reported by B. Pazol et al. in "Development of Sapphire Windows for use in High-Quality IR Imaging Systems," SPIE Vol. 1760 Window and Dome Technologies and Materials III, pps. 55–65 (1992), the teachings of which are incorporated herein by reference. These thin sapphire sheets can therefore be used as supports for the semiconductor coatings with minimal optical thickness at microwave wavelengths (10 mils of sapphire is 1/50-wave optical thickness at 10 GHz). Getting the sapphire sheets as thin as possible is critical, as will be discussed below. In another preferred embodiment of the invention, 5 mil thick sapphire sheets are used to minimize the amount of sapphire in the cavities. Sapphire sheets as thin as 5 mils are commercially available from Litton Industries, Itek Optical Systems, of Lexington, Mass.

Figure 9:
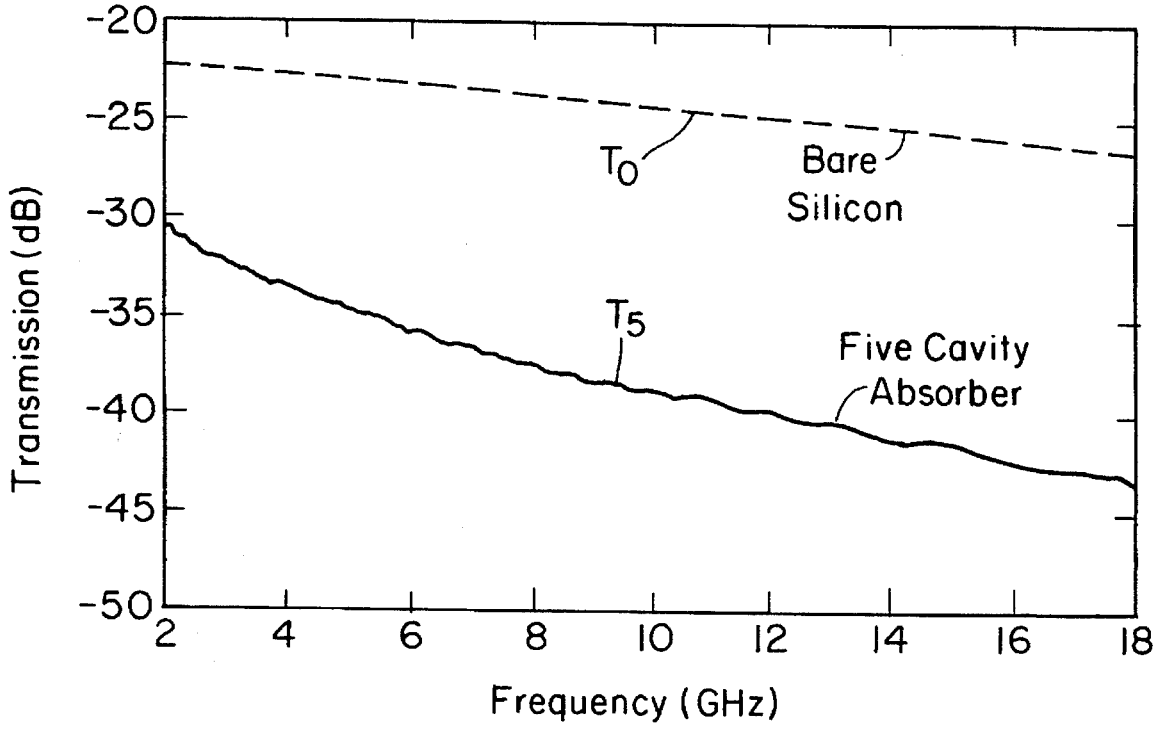
FIG. 9 is a graphical diagram of RF transmission through a silicon substrate and a five-cavity absorbing window with the same silicon substrate.

FIG. 9 is a graphical diagram comparing RF transmission through a bare silicon substrate (not shown) and a five-cavity absorbing window (not shown). Curve $T_0$ illustrates the transmission through bare silicon. Curve $T_5$ illustrates the transmission through a five-cavity absorber. For both curves, a 15 Ω/□ silicon substrate was used.

An infrared transmission concern for preferred embodiments of the invention can be the antireflection coating because of the large number of surfaces. This can become a limiting factor in the number of cavities used in a given embodiment. High efficiency visible or infrared antireflection coatings are therefore required in preferred embodiments of the invention.

Figure 10:
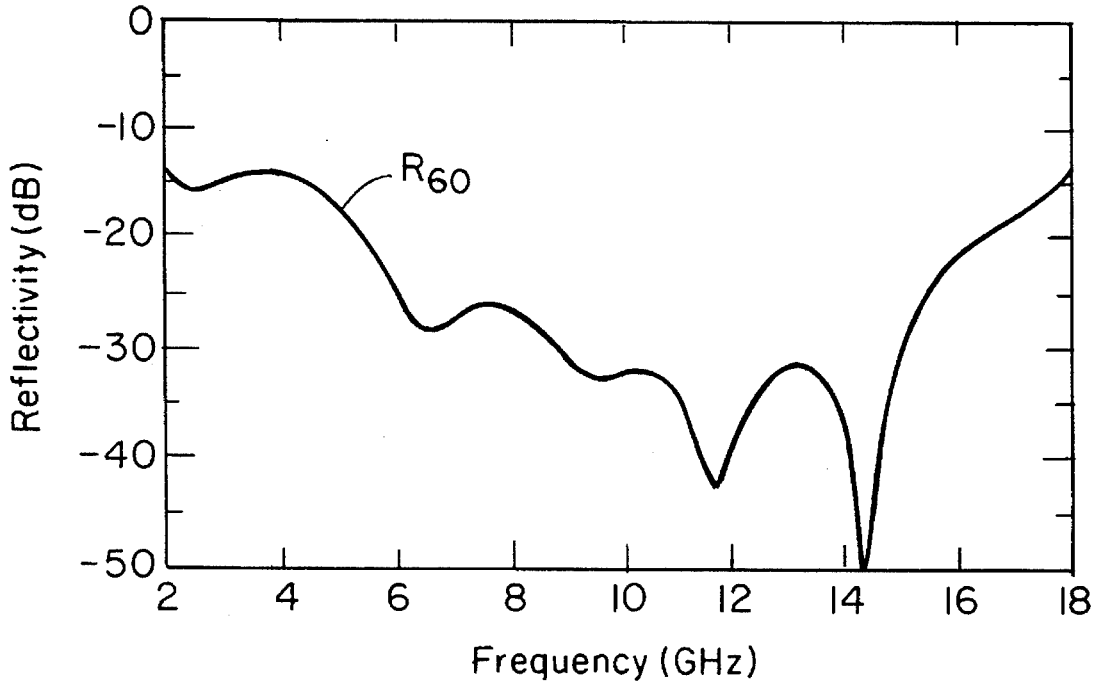
FIG. 10 is a graphical diagram illustrating the reflectivity at normal incidence of the window of FIG. 7.

FIG. 10 is a graphical diagram of reflectivity at normal incidence of the five-cavity observing window of FIG. 7. As illustrated, the window reflection attenuation is below −20 dB between 6 and 16 GHz. By reducing the sapphire thickness, the attenuation bandwidth can be increased. It can be shown that the absorption band can be further broadened by adding even more cavities. Using a six-cavity dark mirror, the entire 2–18 GHz band can be covered by a 20 dB reflection attenuation.

Figure 11:
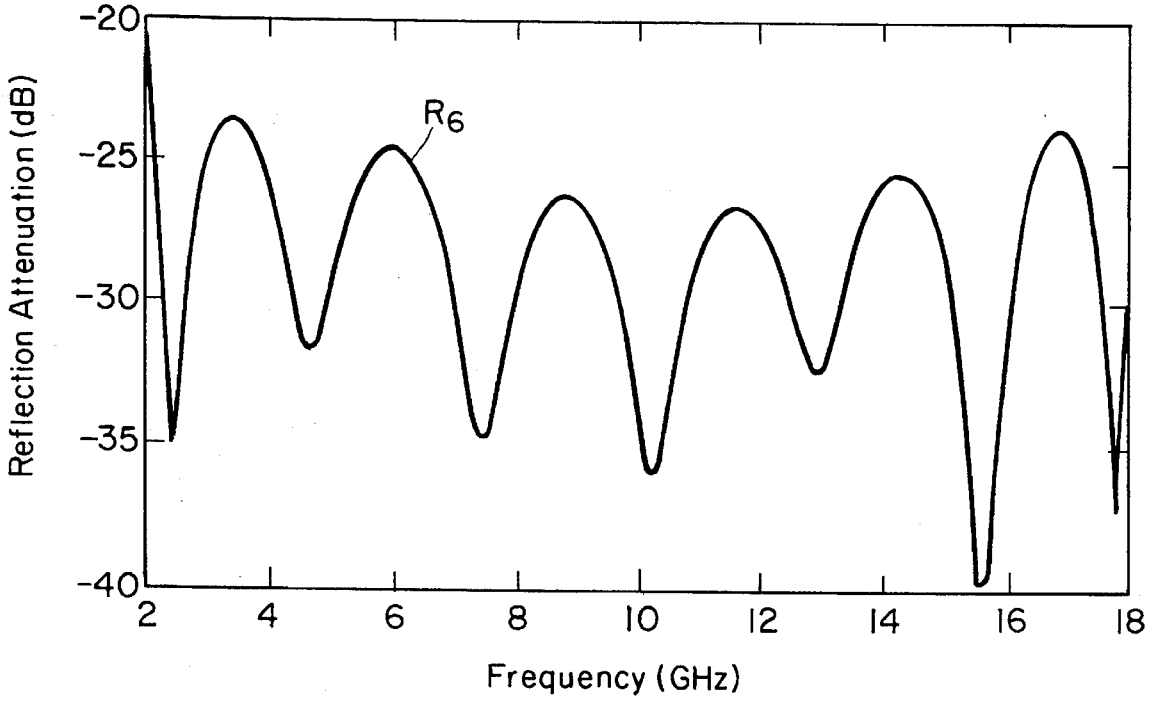
FIG. 11 is a graphical diagram illustrating reflection attenuation for a six-cavity absorbing window.

FIG. 11 is a graphical diagram of reflection attenuation around a predetermined frequency of 10 GHz for the six-cavity absorbing window of Table 2 according to a preferred embodiment of the invention. The rear mirror is a 5–10 Ω-cm silicon substrate having a thickness chosen to give the appropriate transmission attenuation and structural properties. The other cavity mirrors consist of two different resistivity semiconductor layers coated on the front of 5 mil thick sapphire sheets. As noted above, the coatings could equally well be located on the rear side of the sapphire panes. Using two semiconductor layers instead of one adds extra degrees of freedom for an optimization process. As illustrated, this embodiment gives greater than 25 dB reflection attenuation from 2.0 to 18.0 GHz.

Figure 12:
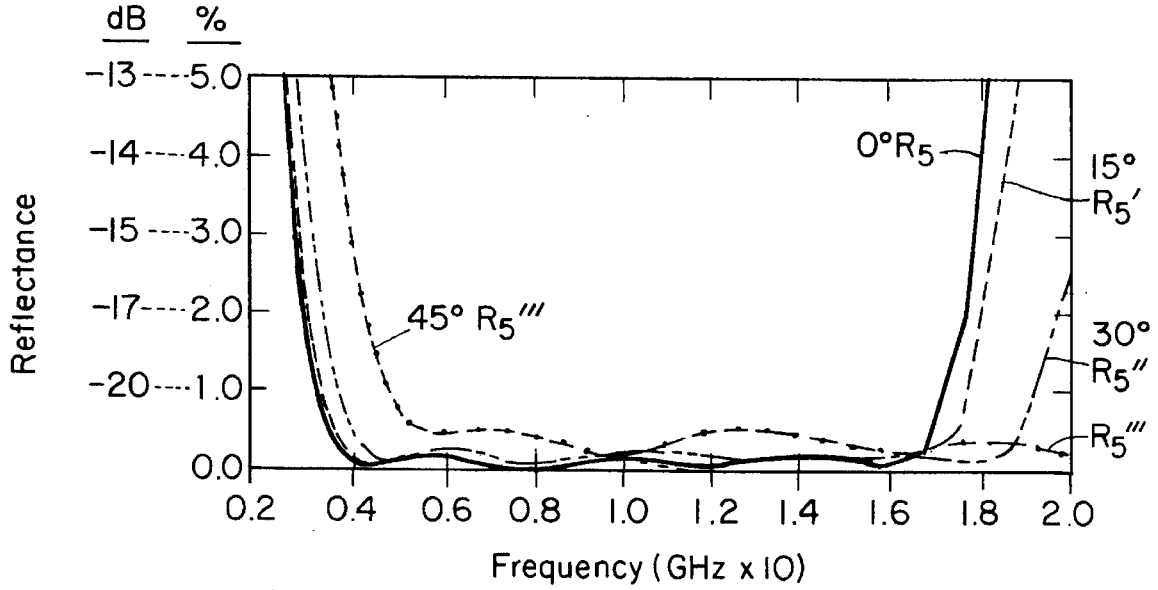
FIG. 12 is a graphical diagram illustrating reflection attenuation of a five-cavity absorbing window as a function of angle of incidence.

Any interference structure is sensitive to angle of incidence variations. FIG. 12 is a graphical diagram illustrating variation in angle of incidence and resulting reflection attenuation for a five-cavity dark mirror for angles from 0° to 45°. Curve $R_5$ illustrates reflectance at incidence angle of 0°. Curve $R_5'$ illustrates reflectance attenuation at an incidence angle of 15°. Curve $R_5''$ illustrates reflectance attenuation at an incidence angle of 30°. Curve $R_5'''$ illustrates reflection attenuation at incidence angle of 45°. As shown, attenuation holds up well for angles less than 45°, with a normal shift of the absorption band to higher frequencies with increasing angle. A preferred embodiment utilizes an absorption bandwidth sufficient to compensate for this frequency shift.

Figure 13:
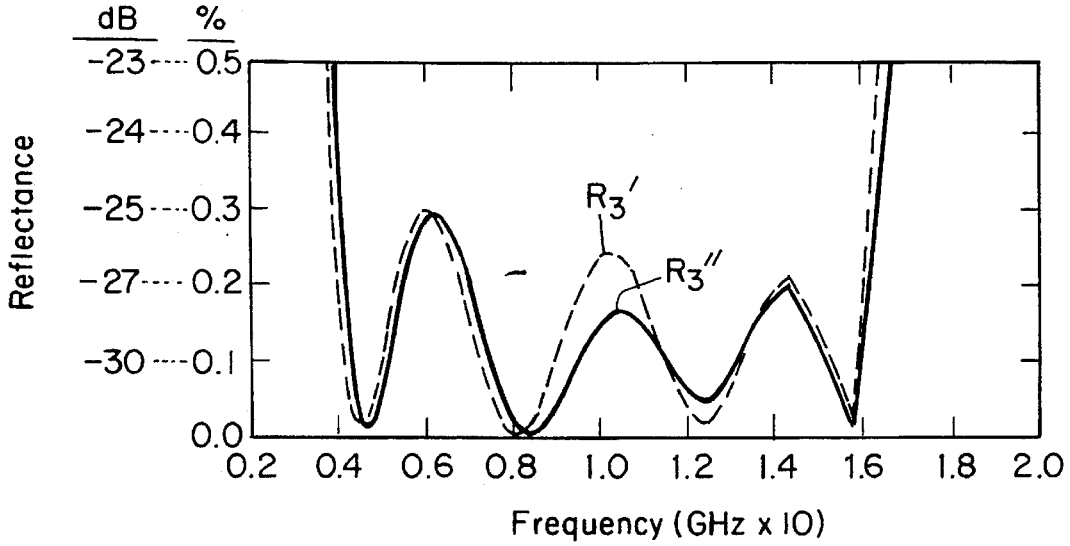
FIG. 13 is a graphical diagram illustrating reflectance for a three-cavity dark mirror at extreme polarization.

Sapphire birefringence can be a concern because the dielectric constant varies between nine and eleven as a function of polarization in the microwave region. FIG. 13 is a graphical diagram illustrating reflectance for a three-cavity dark mirror 30 at extreme polarization cases, with a refractive index difference of 0.3. As shown, the birefringence effect is minimal because of the use of thin sapphire layers.

Figure 14:
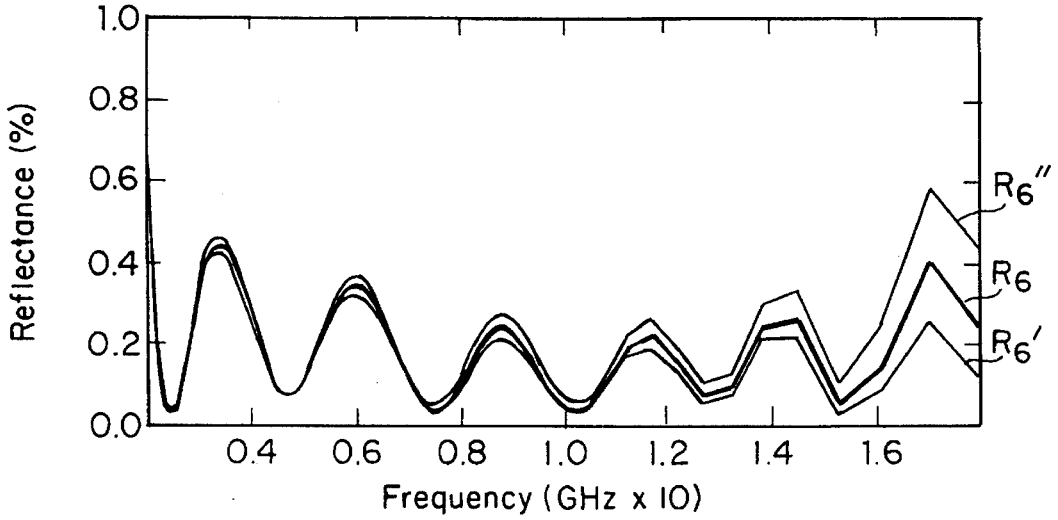
FIG. 14 is a graphical diagram illustrating variation in reflectance for the six-cavity dark mirror of FIG. 11 with errors in air-gap thicknesses of ±2 mils.
Figure 15:
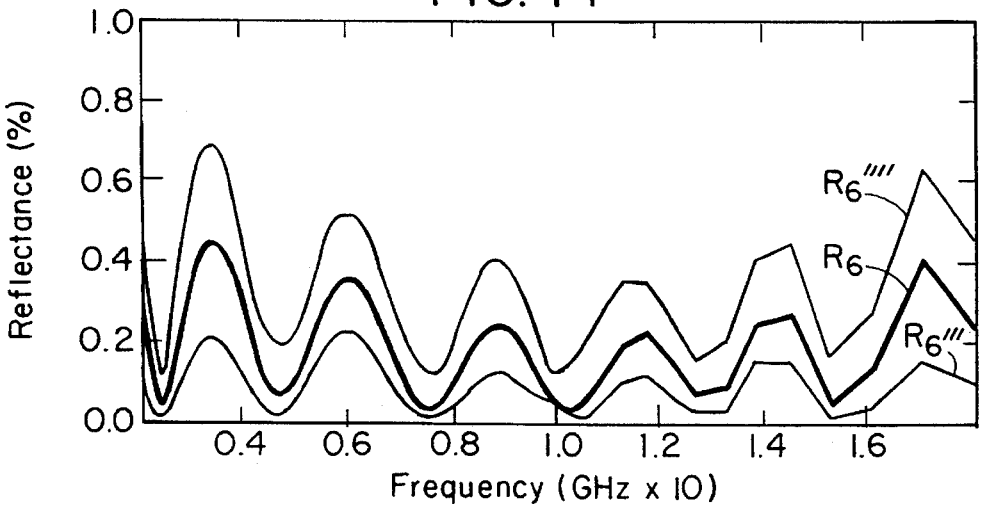
FIG. 15 is a graphical diagram illustrating variation and reflectance for the six-cavity dark mirror of FIG. 11 with errors in the coating sheet resistances of ±10%.

Tolerancing requirements for preferred embodiments of the invention are achievable, at least for 20 to 25 dB reflection attenuation. FIG. 14 is a graphical diagram of variation in reflectance for the six-cavity dark mirror of FIG. 11 with an air gap thickness variation of ±2 mils. The actual reflectance, shown by curve $R_6$, falls within the outer two envelopes $R_6'$,$R_6''$. FIG. 15 is a graphical diagram of variation in reflectance for the six-cavity dark mirror of FIG. 11 with a coating sheet resistance variation of ±10%. The actual reflectance, shown by curve $R_6$, falls within the outer two envelopes $R_6'''$,$R_6''''$. For the six-cavity dark mirror of FIG. 11, a spacer layer tolerance of ±2 mils and a conductive coating sheet resistance tolerance of ±10% is acceptable. The sheet resistance tolerance equates to a resistivity tolerance because the thin film thickness can be controlled very precisely.

The above description only takes into account specular reflection. In radar absorbing embodiments, edge effects and surface waves can dominate a radar cross-section. In addition, the two inch depth of windows according to preferred embodiments of the invention increases the importance of internal reflections.

Sapphire is an acceptable material for the 3–5 μm band, but not the 8–12 μm LWIR band. Silicon is believed to be a suitable replacement material for the LWIR band if thin silicon can be fabricated with the required mechanical properties.

A window composed of thin sheets with air spacers may not be an ideal structural design, even if the sheets are fabricated from sapphire. In a preferred embodiment, the structure can be stiffened by filling the spacers with a material denser than air, such as an aerogel material. A low density aerogel only degrades the RF attenuation by a few dB. An alumina aerogel can be an alternative as a MWIR transmitting spacer.

Equivalents

Those skilled in the art will know, or be able to ascertain using no more than routine experimentation, many equivalents to the specific embodiments of the invention described herein. These and all other equivalents are intended to be encompassed by the following claims.

The invention claimed is:

1. A radio frequency absorbing panel having a front side adapted to be exposed to an external environment including electromagnetic energy and a back side opposite the external environment, the panel comprising:

a series of parallel light transparent electrically conductive sheets, each conductive sheet spaced apart from an adjacent conductive sheet by a respective intermediate spacing distance, the spacing distance determined as a function of a predetermined radio frequency such that the conductive sheets absorbs substantially all electromagnetic energy at the predetermined radio frequency; and a light transparent dielectric material disposed in the spacing between each conductive sheet to create an interference cavity between each conductive sheet.

2. The panel of claim 1 wherein the conductive sheets comprise:

a layer of light transparent material for providing a structural base to the conductive sheet; and a layer of light transparent conducting material on a side of the rigid layer for providing an electrical conductor for the conductive sheet.

3. The panel of claim 1 further comprising an antireflection coating disposed on the front side of the panel.

4. A radio frequency absorbing panel having a front side adapted to be exposed to an external environment including electromagnetic energy and a back side opposite the external environment, the panel comprising:

a series of parallel light transparent electrically conductive sheets having a layer of light transparent conducting material on a side of a layer of light transparent substrate material, each conductive sheet spaced apart from an adjacent conductive sheet by a respective intermediate spacing distance, the spacing distance being approximately one-quarter of a wavelength of a predetermined radio frequency such that the conductive sheets absorb substantially all electromagnetic energy at the predetermined radio frequency;

a first light transparent dielectric material disposed in the spacing between each conductive sheet to create an interference cavity between each conductive sheet; and an antireflection coating disposed on the front side of the panel.

5. The panel of claim 4 wherein the back side of the panel is adjacent to a sensor cavity.

6. The panel of claim 4 wherein the panel is transparent to visible light.

7. The panel of claim 4 wherein the panel is transparent to infrared light.

8. The panel of claim 4 wherein the substrate material is selected from the group consisting of Si, sapphire, GaAs, ZnS, ZnSe, Ge, glass and plastics.

9. The panel of claim 4 wherein the back side layer of substrate material comprises silicon and remaining layers of substrate material comprise sapphire.

10. The panel of claim 4 wherein the conducting material is at least one layer of doped semiconductor material.

11. The panel of claim 4 wherein the conducting material is a metal oxide.

12. The panel of claim 4 wherein the antireflection coating comprises a light transparent interface sheet disposed on the front side of the panel and spaced apart from the front conductive sheet by a second light transparent dielectric material.

13. The panel of claim 12 wherein the interface sheet comprises silicon.

14. The panel of claim 12 wherein the interface sheet comprises sapphire.

15. The panel of claim 4 wherein dielectric material has an index of refraction of approximately one at the predetermined radio frequency.

16. The panel of claim 15 wherein the dielectric materials are selected from the group consisting of gases and aerogels.

17. The panel of claim 4 further comprising a transparent electrically conductive substrate on the back side of and parallel with the series of conductive sheets, the substrate spaced apart from the back of the conductive sheets by an intermediate spacing distance.

18. A radio frequency absorbing panel having a front side adapted to be exposed to an external environment including electromagnetic energy and a back side opposite the external environment, the panel comprising:

a transparent electrically conductive substrate;

a series of parallel light transparent electrically conductive sheets spaced apart from the substrate by a respective intermediate spacing distance, each conductive sheet comprising a layer of conducting material on a side of a layer of sapphire and spaced apart from an adjacent conductive sheet by a respective intermediate spacing distance, the spacing distance being approximately equal to one-quarter of a wavelength at a predetermined radio frequency such that the conductive substrate and sheets absorb substantially all electromagnetic energy at the predetermined radio frequency;

a series of gas-filled cavities, each cavity disposed in the spacing behind each conductive sheet to create a series of interference cavities; and a sapphire interface sheet disposed on the front side of the panel and spaced apart from the front conductive sheet by a respective gas-filled cavity to create an antireflection coating on the front side of the panel.

19. The panel of claim 18 wherein the backside of the panel is adjacent to a sensor cavity.

20. The panel of claim 18 wherein the panel is transparent to visible light.

21. The panel of claim 18 wherein the panel is transparent to infrared light.

22. The panel of claim 18 wherein the conducting material is at least one layer of doped semiconductor material.

23. The panel of claim 18 wherein the conducting material is a metal oxide.

24. The panel of claim 18 wherein the substrate is a doped semiconductor substrate.

25. The panel of claim 18 wherein the substrate has a layer of conductive material.

26. A method of absorbing radio frequency energy in a panel having a front side adapted to be exposed to an external environment including electromagnetic energy and a back side opposite the external environment, the method comprising the steps of:

forming a plurality of light transparent electrically conductive sheets;

arranging each conductive sheet in series and in parallel with an adjacent conductive sheet;

spacing the conductive sheets apart by a respective intermediate spacing distance, the spacing distance determined as a function of a predetermined radio frequency such that the conductive sheets absorb substantially all electromagnetic energy at the predetermined radio frequency; and disposing a light transparent dielectric material in the spacing between each conductive sheet to create an interference cavity between each conductive sheet.

27. The method of claim 26 wherein the step of forming conductive sheets comprises the step of:

forming a layer of light transparent substrate material to provide a structural base to the conductive sheet; and forming a layer of light transparent conducting material on the front side of the substrate material to provide an electrical conductor for the conductive sheet.

28. The method of claim 26 further comprising the steps of disposing an antireflection coating on the front side of the panel.

29. A method of absorbing radio frequency energy in a panel having a front side adapted to be exposed to an external environment including electromagnetic energy and a back side opposite the external environment, comprising the steps of:

forming a plurality of light transparent electrically conductive sheets;

arranging each conductive sheet in series and parallel with an adjacent conductive sheet;

spacing apart the conductive sheets by a respective intermediate spacing distance approximately equal to one-quarter of a wavelength at a predetermined radio frequency such that the conductive sheets absorbs substantially all electromagnetic energy at the predetermined radio frequency;

disposing a first light transparent dielectric material in the spacing between each conductive sheet to create an interference cavity between each conductive sheet; and disposing an antireflection coating on the front side of the panel

30. The method of claim 29 wherein the step of forming conductive sheet comprises the steps of:

forming a layer of light transparent substrate material to provide a structural base to the conductive sheet; and forming a layer of light transparent conducting material on a side of the substrate material to provide an electrical conductor for the conductive sheet.

31. The method of claim 30 wherein the step of forming a layer of substrate material comprises forming a layer from the group of substrate materials consisting of Si, sapphire, GaAs, ZnS, ZnSe, Ge, glass and plastic.

32. The method of claim 30 wherein the step of forming a layer of conducting material comprises forming at least one layer of doped semiconductor material.

33. The method of claim 30 wherein the step of forming a layer of conducting material comprises forming a layer of a metal oxide.

34. The method of claim 29 wherein the step of disposing an antireflection coating comprises the steps of:

disposing a light transparent interface sheet on the front side of the panel; and disposing a second light transparent dielectric material between the interface sheet and the front conductive sheet.

35. The method of claim 34 wherein the step of disposing an interface sheet comprises the step of forming a layer of substrate material.

36. The method of claim 29 wherein the steps of disposing dielectric material comprises the step of selecting a dielectric material having an index of refraction of approximately one at the predetermined radio frequency.

37. A method of absorbing radio frequency energy in a panel having a front side adapted to be exposed to an external environment including electromagnetic energy and a back side opposite the external environment, comprising the steps of:

forming a transparent electrically conductive substrate;

forming a plurality of light transparent electrically conductive sheets by disposing a layer of conducting material on the front side of a layer of sapphire;

arranging each conductive sheet in series and in parallel with an adjacent conductive sheet;

arranging the series of conductive sheets in parallel with the substrate such that the substrate is at the backside of the series of conductive sheets;

spacing apart the conductive sheets and the substrate by a respective intermediate spacing distance approximately equal to one-quarter of a wavelength at a predetermined radio frequency such that the conductive sheets absorbs substantially all electromagnetic energy at the predetermined radio frequency;

disposing a gas in the spacings between the conductive sheets and between the series of conductive sheets and the substrate to create a series of interference cavities in front of the conductive sheets and substrate;

disposing a sapphire interface sheet on the front side of the panel; and disposing a gas between the interface sheet and the front conductive sheet to create an antireflection coating on the front side of the panel.

38. The method of claim 37 wherein the step of disposing the conducting material comprises the step of forming at least one layer of doped semiconductor material.

39. The method of claim 37 wherein the step of disposing the conducting material comprises the step of forming a metal oxide.

40. The method of claim 37 wherein the step of forming a substrate comprises forming a doped semiconductor substrate.

41. The method of claim 37 wherein the step of forming a substrate comprises forming a layer of conductive material on an insulating substrate.

42. The method of claim 37 wherein the predetermined radio frequency is a radar frequency.

43. The panel of claim 1 wherein the predetermined radio frequency is a radar frequency.

44. The panel of claim 4 wherein the predetermined radio frequency is a radar frequency.

45. The panel of claim 18 wherein the predetermined radio frequency is a radar frequency.

46. The method of claim 26 wherein the predetermined radio frequency is a radar frequency.

47. The method of claim 29 wherein the predetermined radio frequency is a radar frequency.

48. A radio frequency absorbing panel comprising a light transparent radio frequency attenuator having interference cavities therein to absorb substantially all electromagnetic energy at a predetermined radio frequency, the interference cavities being dimensioned as a function of the predetermined radio frequency.

49. The panel of claim 48 wherein the attenuator is transparent to visible light.

50. The panel of claim 48 wherein the attenuator is transparent to infrared light.

51. The panel of claim 48 wherein the predetermined radio frequency is a radar frequency.

52. The panel of claim 48 wherein the attenuator comprises at least one layer of a doped semiconductor material.

* * * * *